US011612215B1

(12) United States Patent
Irving et al.

(10) Patent No.: US 11,612,215 B1
(45) Date of Patent: Mar. 28, 2023

(54) SHOE INSERT ASSEMBLY AND RELATED METHODS

(71) Applicants: Diana Irving, Aventura, FL (US); James Irving, Aventura, FL (US)

(72) Inventors: Diana Irving, Aventura, FL (US); James Irving, Aventura, FL (US)

( * ) Notice: Subject to any disclaimer, the term of this patent is extended or adjusted under 35 U.S.C. 154(b) by 95 days.

(21) Appl. No.: 16/988,074

(22) Filed: Aug. 7, 2020

Related U.S. Application Data

(60) Provisional application No. 62/884,709, filed on Aug. 9, 2019.

(51) Int. Cl.

| | |
|---|---|
| ***A43B 13/00*** | (2006.01) |
| ***A43B 13/38*** | (2006.01) |
| ***A43B 17/18*** | (2006.01) |
| ***A43B 3/26*** | (2006.01) |

(52) U.S. Cl.
CPC ..... *A43B 17/18* (2013.01); *A43B 3/26* (2013.01)

(58) Field of Classification Search
CPC ..... A43B 3/26
See application file for complete search history.

(56) References Cited

U.S. PATENT DOCUMENTS

| | | | | |
|---|---|---|---|---|
| 4,813,157 | A * | 3/1989 | Boisvert | A43B 7/1445 36/145 |
| 5,740,618 | A | 4/1998 | Minden | |
| 6,082,027 | A * | 7/2000 | Wagonhurst | A43B 5/0405 36/117.6 |
| 6,205,685 | B1 * | 3/2001 | Kellerman | A43B 1/0072 36/44 |
| 6,442,874 | B1 | 9/2002 | Long | |
| 6,584,707 | B1 | 7/2003 | Racine | |
| 8,463,657 | B1 | 6/2013 | Bentvelzen | |
| 2006/0059726 | A1 | 3/2006 | Song | |
| 2006/0210751 | A1 | 9/2006 | Cunningham | |
| 2008/0127518 | A1 * | 6/2008 | Byrne | A43B 7/1445 36/97 |
| 2010/0083534 | A1 * | 4/2010 | Howlett | A43B 3/26 36/43 |
| 2010/0251568 | A1 * | 10/2010 | Haruda | A43B 17/102 36/43 |
| 2011/0099845 | A1 | 5/2011 | Miller | |
| 2011/0185600 | A1 * | 8/2011 | Malek | A43B 17/18 36/43 |
| 2014/0259752 | A1 * | 9/2014 | Feldman | A43B 7/1464 36/43 |

* cited by examiner

*Primary Examiner* — Jila M Mohandesi
(74) *Attorney, Agent, or Firm* — Allen, Dyer, Doppelt & Gilchrist, P.A.

(57) ABSTRACT

A fit of a shoe is adjusted using a shoe insert assembly. A shoe insert assembly includes a shoe insole and a shoe insert having a fastener element configured for connection to the shoe insole. The shoe insole with the shoe insert connected thereto by the fastener element are receivable into a shoe. The shoe insert can be attached to the shoe insole in multiple manners, including adhesively, using a hook and loop fastener, and using a coupling strip.

20 Claims, 9 Drawing Sheets

SHOE INSERT ASSEMBLY AND RELATED METHODS

CROSS-REFERENCE TO RELATED APPLICATION

This application claims the benefit of U.S. Provisional Patent Application Ser. No. 62/884,709, filed on Aug. 9, 2019, the contents of which are herein incorporated by reference in their entirety.

FIELD OF THE INVENTION

The present invention relates to shoe inserts, and more particularly, to inserts for adjusting an effective size of a shoe and methods for securing the same inside a shoe.

BACKGROUND OF THE INVENTION

Various examples of a shoe insert that allows a wearer to adjust an effective size of his or her shoe can be seen in U.S. Pat. No. 9,380,833 (the '833 Patent), the contents of which are herein incorporated by reference in their entirety. Different mechanisms by which a shoe insert can be affixed inside the shoe during use are disclosed by the '833 Patent, although further improvements are possible.

SUMMARY OF THE INVENTION

In view of the foregoing, it is an object of the present invention to provide an improved shoe insert assembly, as well as related methods for securing the shoe insert inside a shoe. According to an embodiment of the present invention, a shoe insert assembly includes a shoe insole and a shoe insert having a fastener element configured for connection to the shoe insole. The shoe insole with the shoe insert connected thereto by the fastener element are receivable into a shoe for adjusting a fit thereof.

According to an aspect of the present invention, the fastener element includes an adhesive connectable to a complementary surface for adhesion on the shoe insole.

According to another aspect, the fastener element includes a portion of a hook and loop fastener on the fastener element connectable to a complementary portion of a hook and loop fastener on the shoe insole. Advantageously, an entire upper surface of the shoe insole is made from a material having sufficient nap to form a loop portion engageable by a hook portion on the shoe insert.

According to a further aspect, the fastener element includes a coupling strip and the shoe insole defines at least one insole opening dimensioned to receive the coupling strip therethrough for connection of the shoe insert to the shoe insole. Advantageously, the at least one insole opening includes a plurality of aligned insole openings proximate an edge of the shoe insole allowing the shoe insole to be cut to smaller sizes while still receiving the coupling strip of the shoe insert proximate the edge.

According to a method aspect, a method for adjusting fit of a shoe includes attaching a shoe insert to a shoe insole using a fastener element, and inserting the shoe insole into a shoe.

According to another embodiment, a shoe assembly includes a shoe, a removable shoe insole located in the shoe, and a shoe insert adhesively fastened to an upper surface of a toe area of the shoe insole so as to adjust a fit of the shoe.

These and other objects, aspects and advantages of the present invention will be better appreciated in view of the drawings, and following detailed description of preferred embodiments.

DETAILED DESCRIPTION OF PREFERRED EMBODIMENTS

Figure 1:
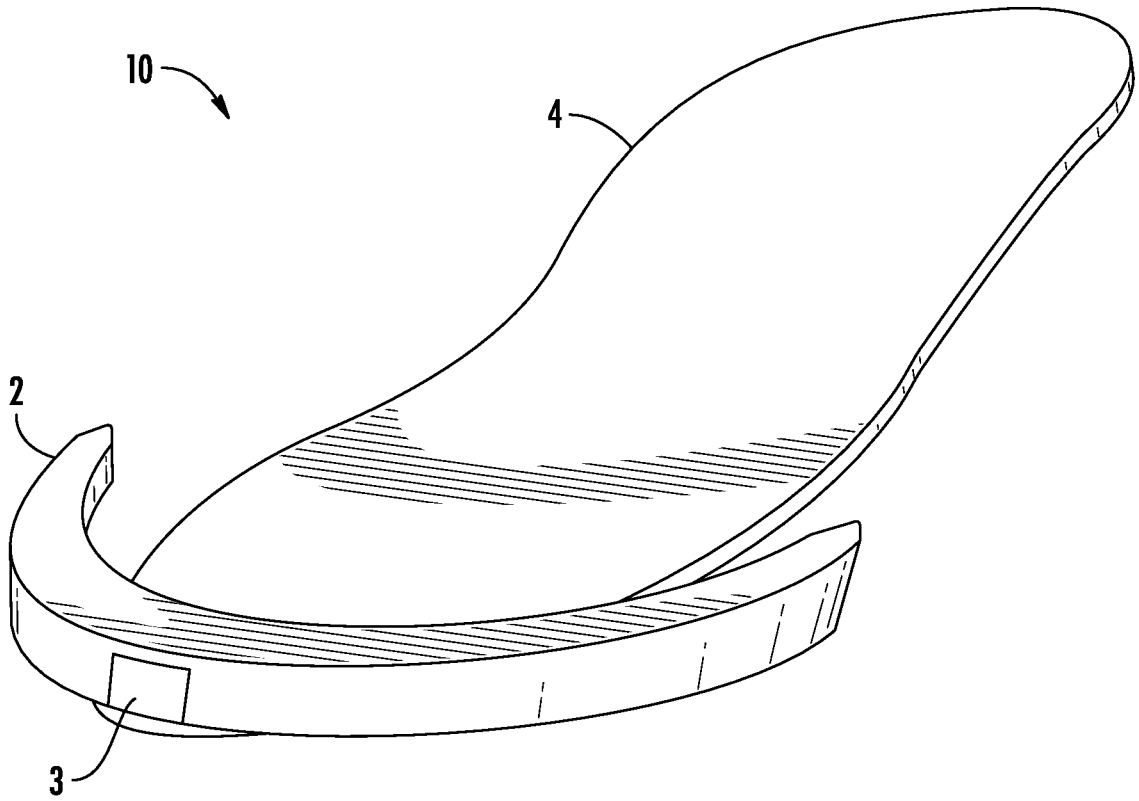
FIG. 1 is a perspective view of a shoe insert assembly, including a shoe insert, an insole and a coupling strip, according to an embodiment of the present invention.
Figure 8:
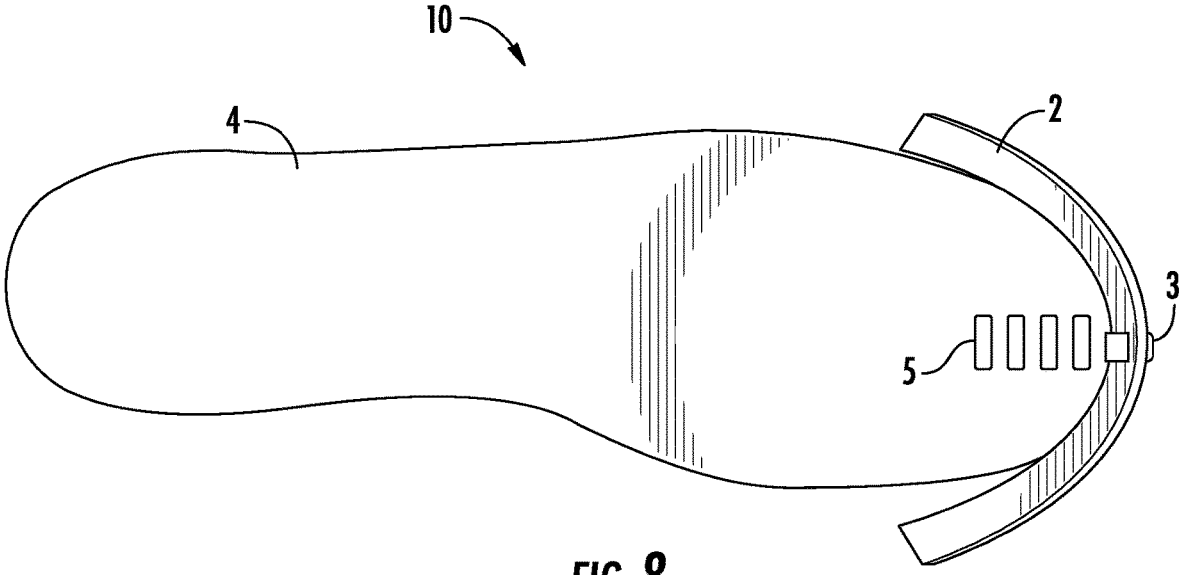
FIG. 8 is a top view of the shoe insert assembly of FIG. 1.
Figure 9:
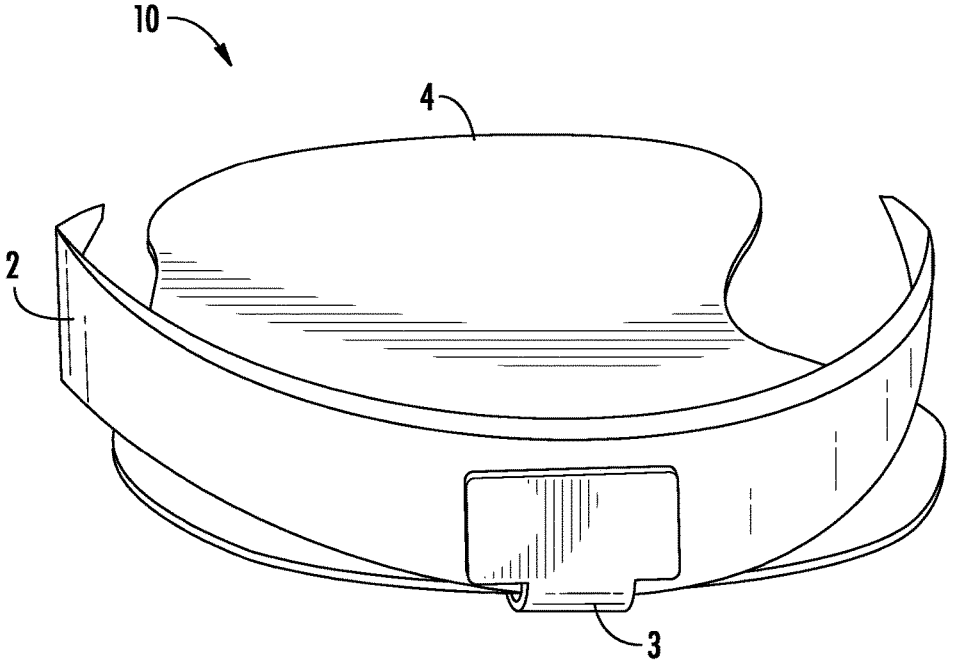
FIG. 9 is a front view of the shoe insert assembly of FIG. 1.

According to an embodiment of the present invention, referring to FIGS. 1, 8 and 9, a shoe insert assembly 10 includes a shoe insert 2, a coupling strip 3 and an insole 4. The coupling strip 3 serves as a fastener element and is fitted through the shoe insert 2 and the insole 4 and securely engages the insert 2 to a desired position on the insole 4. For efficiency of illustration only a single insert is depicted. It will be appreciated that a set of two inserts would typically be employed.

In the depicted embodiment, the shoe insert 2 is a single piece. Alternately, the shoe insert 2 could be formed of a plurality of layers (an example of which can be seen in the '833 Patent), allowing a thickness of the insert to be adjusted. Additionally, the shoe insert 2 is attached to a toe region of the insole 4 in the depicted embodiment; however, it will be appreciated that an insert could be attached to any desired position (including multiple positions) of the insole. Moreover, the depicted insole 4 is a full insole, dimensioned to cover essentially the entire insole area of a given shoe. A partial insole could also be used.

Figure 2:
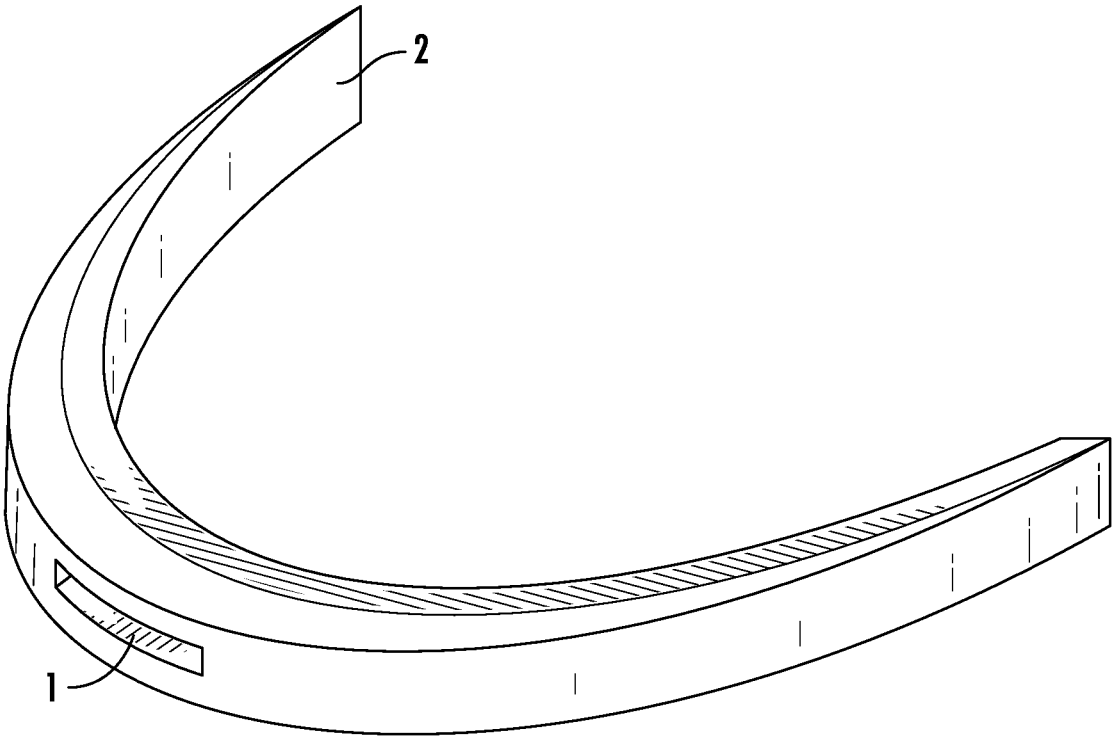
FIG. 2 is a perspective view of the shoe insert of FIG. 1.
Figure 3:
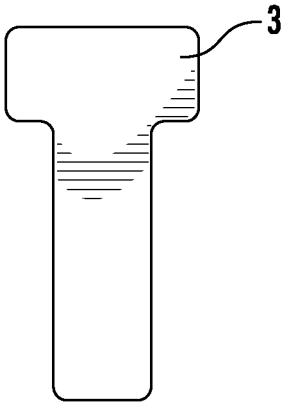
FIG. 3 is a perspective view of the coupling strip of FIG. 1.
Figure 4:
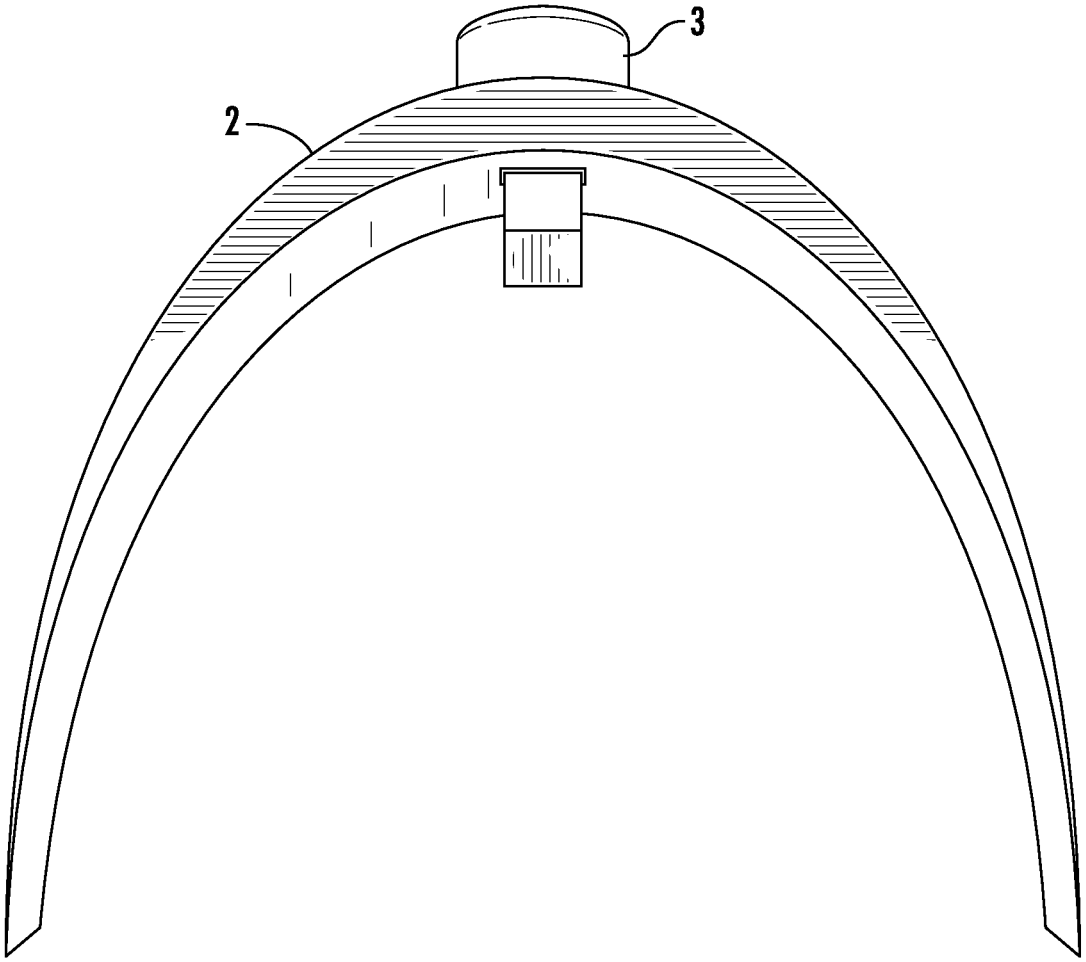
FIG. 4 is a perspective view of the shoe insert and coupling strip of FIG. 1, with the coupling strip fitted through the shoe insert.

Referring to FIG. 2, the shoe insert 2 includes an opening 1 extending between front and rear surfaces thereof. Referring to FIG. 3, the coupling strip 3 includes a tail portion dimensioned to be fitted through the opening 1 and a wider head portion that preferably does not fit through the opening 1. In FIG. 4, the tail portion of the coupling strip 3 has been fitted through the opening 1.

Figure 5:
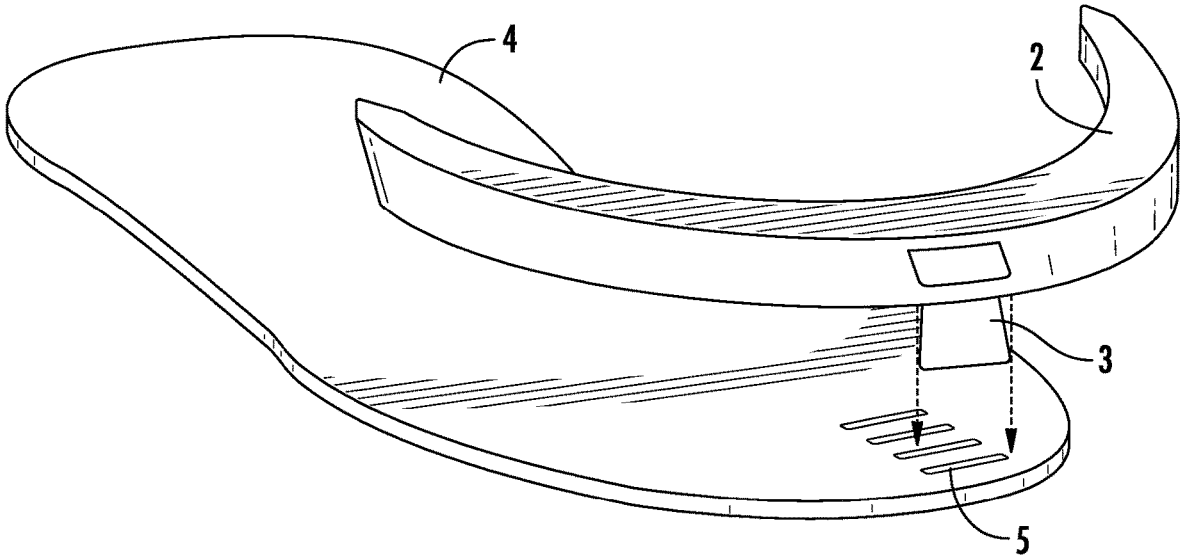
FIG. 5 is a partially exploded perspective view of the shoe insert assembly of FIG. 1, with the shoe insert and fitted coupling strip positioned above the insole.
Figure 6:
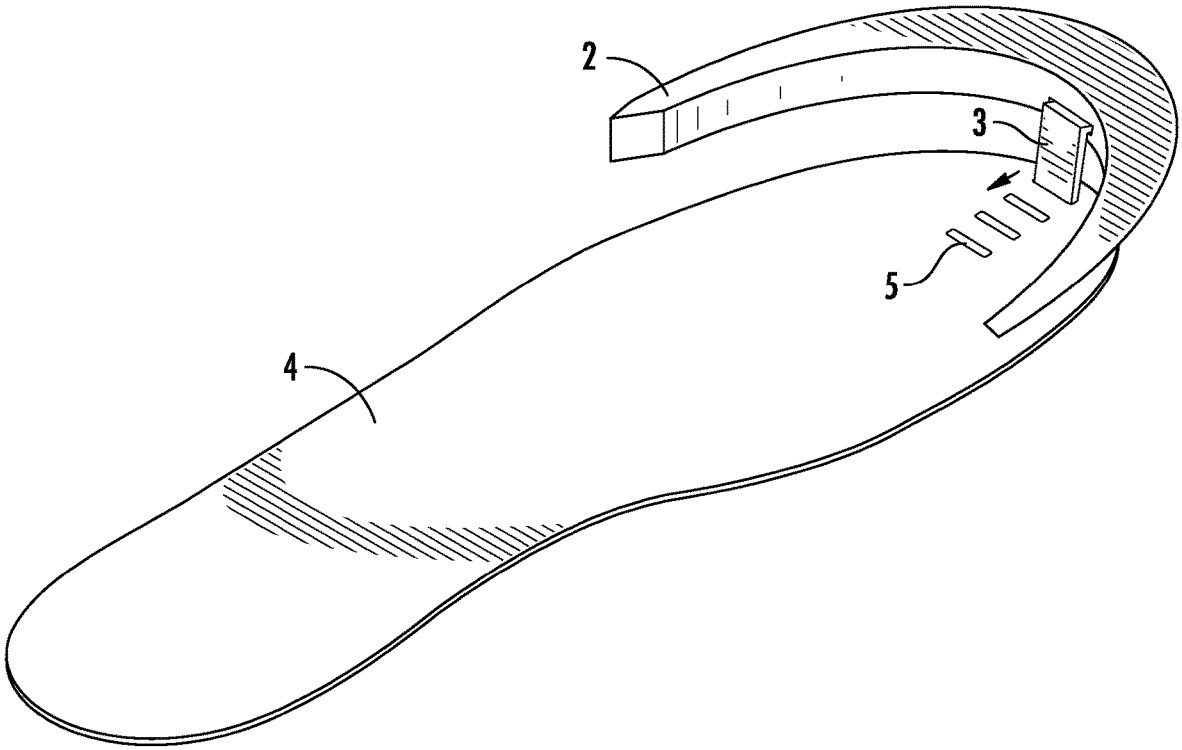
FIG. 6 is a partially exploded perspective view of the shoe insert assembly of FIG. 1, with the coupling strip fitted through the shoe insert and being fitted into the shoe insole.

Referring to FIGS. 5 and 6, the insole 4 also includes an opening 5 dimensioned to receive the tail portion of the coupling strip 3 after fitting through the shoe insert 2. Advantageously, the insole 4 is provided with a plurality of aligned openings 5, allowing the insole 4 to be cut to smaller sizes while still receiving the shoe insert 2 proximate a desired edge thereof.

Figure 7:
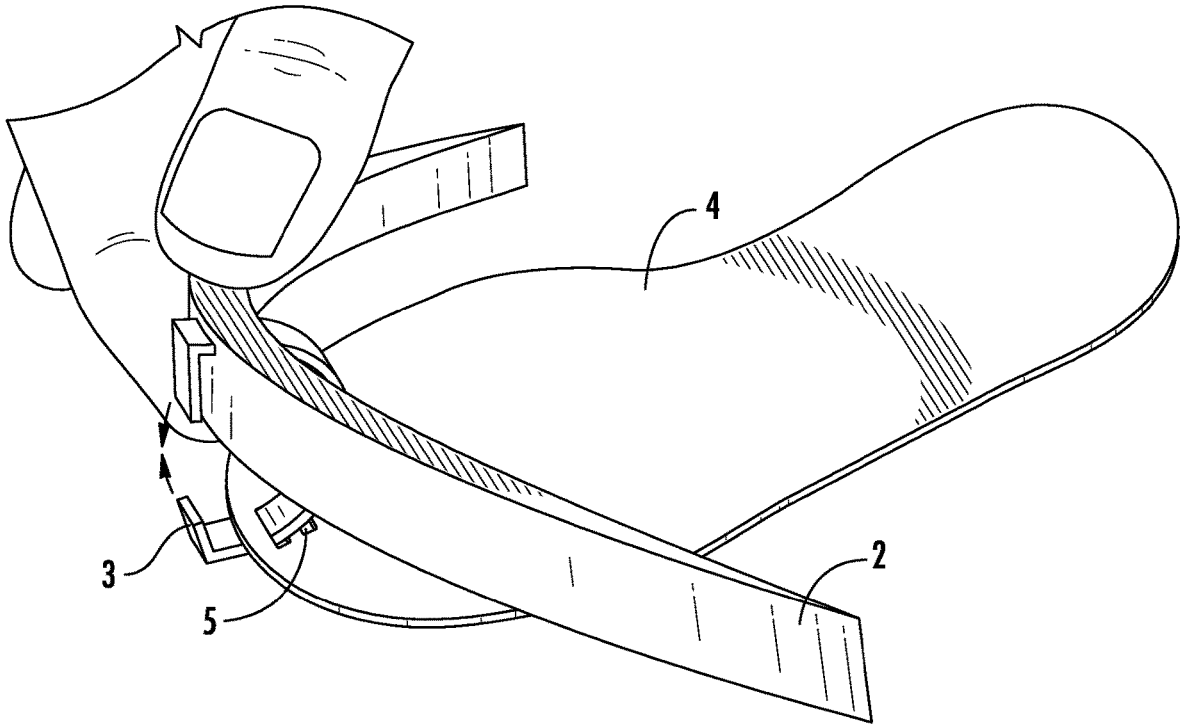
FIG. 7 is a partially exploded perspective view of the shoe insert assembly of FIG. 1, with the coupling strip fitted through the shoe insert and the shoe insole and routed back towards itself.

Referring to FIG. 7, after fitting through the openings 1, 5 in the shoe insert 2 and insole 4, respectively, the tail portion of the coupling strip 3 is looped back and affixed to the head portion. Various attachment mechanisms can be employed for this affixation, including but not limited to adhesives, hook and loop fasteners, magnets, buckles, snap fasteners and pin and post fasteners.

Figure 10:
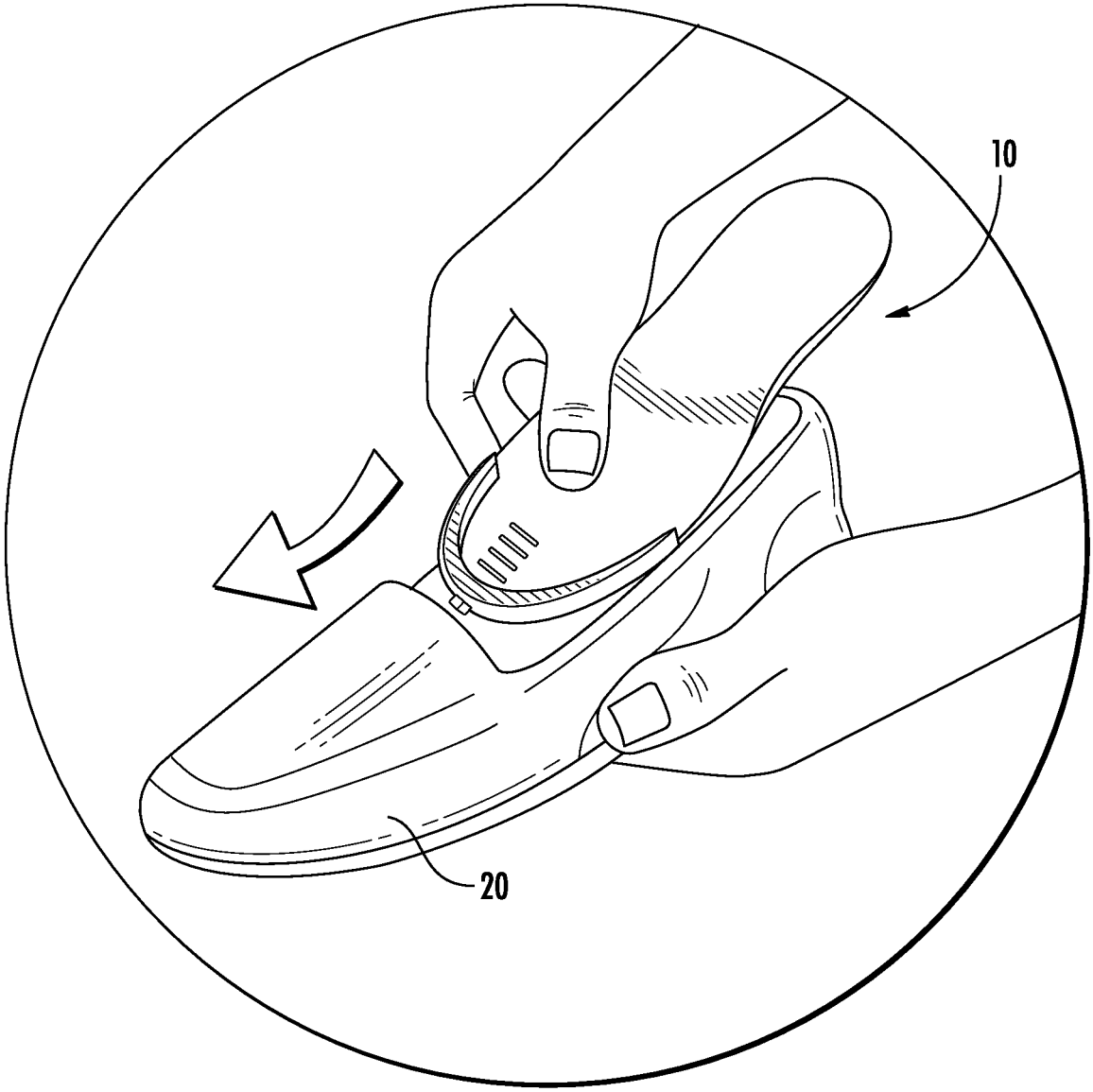
FIG. 10 is a perspective view of the shoe insert assembly of FIG. 1 being inserted into a shoe.

Referring to FIG. 10, with the shoe insert 2 securely attached to the desired edge of the insole 4 by the coupling strip 3, the shoe insert assembly 10 is then placed inside a shoe 20. Placement of the insert 2 at the desired position within the shoe 20 is thereby accomplished.

Figure 11:
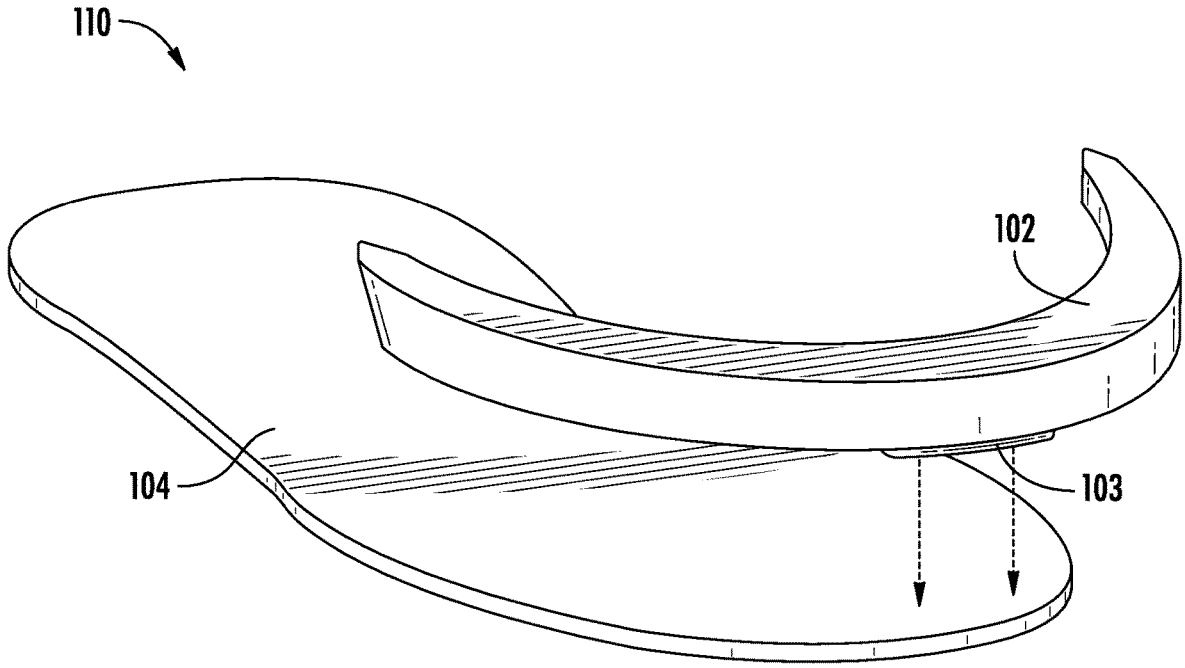
FIG. 11 is a perspective view of a shoe insert assembly, including a shoe insert and an insole, according to another embodiment of the present invention.
Figure 12:
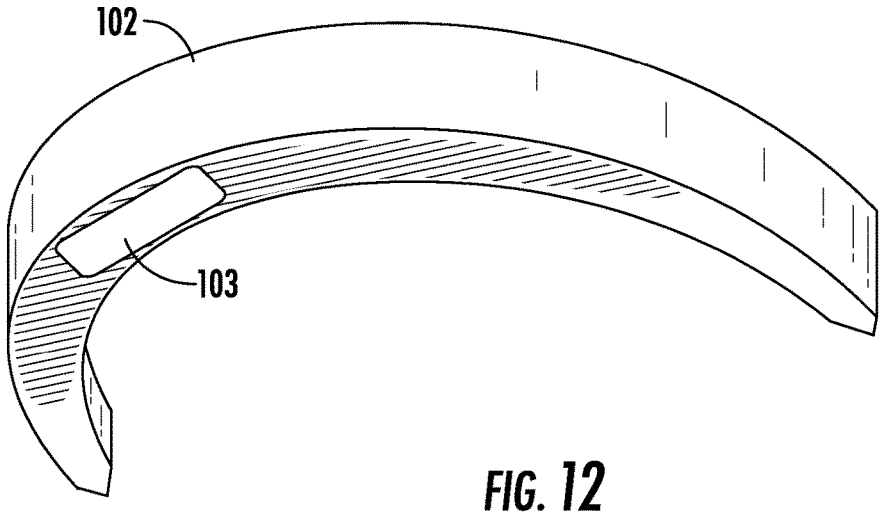
FIG. 12 is a perspective view of the shoe insert of FIG. 11.

Referring to FIGS. 11 and 12, according to another embodiment of the present invention, a shoe insert assembly 110 includes a shoe insert 102 releasably connected by at least one fastener element 103 directly to an insole 104. Except as described herein, the shoe insert 102 and insole 104 can be substantially identical to the shoe insert 2 and insole 4 described above.

The fastener element 103 is connected to an under side of the shoe insert 102 and advantageously formed as a hook portion of a hook and loop fastener. The upper surface of the insole 104, at least in a toe area thereof, is preferably formed of a material having sufficient nap to engage the fastener element 103. Alternately, a separate loop portion can be attached to the upper surface of the insole 104 in the toe area. In another alternative, the fastener element 103 could include a releasable or permanent adhesive with the insole 104 having a complementary surface for adhesion. Other fasteners could also be used.

With the fastener element 103 connecting the shoe insert 102 to the insole in a desired position, the shoe insert assembly 110 is then placed into a shoe, substantially as shown in FIG. 10, above. Alternatively, the shoe insert 102 could be inserted into the shoe with the insole 102 already in place. The direct attachment of the fastener element 103 to a complementary upper surface of the insole 104 allows the insole to be cut to any desired size and profile, while still allowing attachment of the shoe insert thereto at any desired position.

The foregoing is provided for illustrative and exemplary purposes; the present invention is not necessarily limited thereto. Rather, those skilled in the art will appreciate that various modifications, as well as adaptations to particular circumstances, are possible within the scope of the invention as herein shown and described and of the claims appended hereto.

What is claimed is:

1. A shoe insert assembly comprising:

a shoe insole;

a shoe insert having a fastener element configured for connection to the shoe insole;

wherein the shoe insole with the shoe insert connected thereto by the fastener element are receivable into a shoe for adjusting a fit thereof;

wherein the fastener element includes a coupling strip and the shoe insole defines at least one insole opening dimensioned to receive the coupling strip therethrough for connection of the shoe insert to the shoe insole; and wherein the at least one insole opening includes a plurality of aligned insole openings proximate an edge of the shoe insole allowing the shoe insole to be cut to smaller sizes while still receiving the coupling strip of the shoe insert proximate the edge.

2. The shoe insert assembly of claim 1, wherein the shoe insert is a single piece.

3. The shoe insert assembly of claim 1, wherein the shoe insert is formed of a plurality of detachable layers allowing a thickness of the shoe insert to be adjusted.

4. The shoe insert assembly of claim 1, wherein the edge is along a toe area of the shoe insole.

5. A shoe insert assembly comprising:

a shoe insole;

a shoe insert having a fastener element configured for connection to the shoe insole;

wherein the shoe insole with the shoe insert connected thereto by the fastener element are receivable into a shoe for adjusting a fit thereof;

wherein the fastener element includes a coupling strip and the shoe insole defines at least one insole opening dimensioned to receive the coupling strip therethrough for connection of the shoe insert to the shoe insole; and wherein the coupling strip extends through an insert opening defined extending between front and rear surfaces of the shoe insert.

6. The shoe insert assembly of claim 5, wherein the coupling strip includes a tail portion dimensioned to be fitted through the at least one insole opening and a head portion dimensioned to be wider than the insert opening.

7. The shoe insert assembly of claim 6, wherein the coupling strip includes an attachment mechanism for releasably affixing the head and tail portions.

8. The shoe insert assembly of claim 5, wherein the shoe insert is a single piece.

9. The shoe insert assembly of claim 5, wherein the shoe insert is formed of a plurality of detachable layers allowing a thickness of the shoe insert to be adjusted.

10. The shoe insert assembly of claim 5, wherein the at least one insole opening is located along an edge of the shoe insole in a toe area thereof.

11. A method for adjusting fit of a shoe, the method comprising:

attaching a shoe insert to a shoe insole using a fastener element; and inserting the shoe insole into a shoe;

wherein attaching the shoe insert to the shoe insole includes inserting a coupling strip of the shoe insert through an insole opening proximate an edge of the shoe insole; and wherein the insole opening is one of a plurality of aligned insole openings and method further comprises cutting the shoe insole to a desired size between the plurality of aligned insole openings such that the insole opening through which the coupling strip is inserted is most proximate to the edge of the shoe insole.

12. The method of claim 11, wherein the shoe insole is inserted into the shoe after attaching the shoe insert to the shoe insole.

13. The method of claim 11, further comprising a preliminary step of cutting the shoe insole to a desired size.

14. The method of claim 11, further comprising a preliminary step of adjusting a thickness of the shoe insert.

15. The method of claim 11, wherein inserting the coupling strip through the insole opening includes inserting the coupling strip through the insole opening at a toe area of the shoe insole.

16. A method for adjusting fit of a shoe, the method comprising:

attaching a shoe insert to a shoe insole using a fastener element; and inserting the shoe insole into a shoe;

wherein attaching the shoe insert to the shoe insole includes inserting a coupling strip of the shoe insert through an insole opening proximate an edge of the shoe insole; and attaching head and tail portions of the coupling strip after inserting the coupling strip of the shoe insert through the insole opening.

17. The method of claim 16, wherein the shoe insole is inserted into the shoe after attaching the shoe insert to the shoe insole.

18. The method of claim 16, further comprising a preliminary step of cutting the shoe insole to a desired size.

19. The method of claim 16, further comprising a preliminary step of adjusting a thickness of the shoe insert.

20. The method of claim 16, wherein inserting the coupling strip through the insole opening includes inserting the coupling strip through the insole opening at a toe area of the shoe insole.

* * * * *